United States Patent [19]

Beeuwkes, III et al.

[11] Patent Number: 5,035,420

[45] **Date of Patent: * Jul. 30, 1991**

[54] JAW EXERCISER

[75] Inventors: Reinier Beeuwkes, III, Ardmore, Pa.; Joseph B. Stella, Amherst, N.H.; Thomas E. Salisbury, Wayland, Mass.

[73] Assignee: Therabite Corporation, Bryn Mawr, Pa.

[ * ] Notice: The portion of the term of this patent subsequent to Mar. 2, 2007 has been disclaimed.

[21] Appl. No.: 474,443

[22] Filed: Feb. 2, 1990

Related U.S. Application Data

[63] Continuation-in-part of Ser. No. 276,695, Nov. 28, 1988, Pat. No. 4,909,002.

[51] Int. Cl.[5] ..... A63B 23/00

[52] U.S. Cl. ..... 272/95

[58] Field of Search ..... 272/94, 95, 125, 126, 272/135, 142, 143, 129; 128/12, 17, 20, 777; 433/69

[56] References Cited

U.S. PATENT DOCUMENTS

| | | | |
|---|---|---|---|
| 742,698 | 10/1903 | Mason . | |
| 3,550,584 | 12/1970 | Ring | 128/17 X |
| 3,721,439 | 3/1973 | Rudolph . | |
| 3,985,125 | 10/1976 | Rose . | |
| 4,002,162 | 1/1977 | Weisser | 128/17 |
| 4,292,026 | 9/1981 | Yokota . | |
| 4,597,382 | 7/1986 | Perez, Jr. | 128/17 |
| 4,686,966 | 8/1987 | Tsai | 128/17 |
| 4,700,695 | 10/1987 | Davis et al. | 272/95 X |
| 4,807,600 | 2/1989 | Hayes | 128/17 |
| 4,909,502 | 3/1990 | Beeuwkes et al. | 272/95 |

FOREIGN PATENT DOCUMENTS

| | | |
|---|---|---|
| 571057 | 2/1933 | Fed. Rep. of Germany . |

*Primary Examiner*—Robert Bahr
*Attorney, Agent, or Firm*—James L. Jackson

[57] ABSTRACT

An exerciser is provided for application of an anatomically applied force to the jaw for pivoting of the jaw at its tempero-mandibular joint or to provide a motion to the jaw, or resistance to motion of the jaw which is beneficial in facial orthopedics. A structure is provided having curvilinear guide tracks which guide movement of a carriage according to the character of movement that is desired. The carriage is movable to thereby allow corresponding movement of a mandibular jaw member supported by the carriage relative to a maxillary jaw member supported by the exerciser body. Through suitable linkages, motion may be imparted to the carriage or resistance exerted against its motion by manual action, by a spring or by a motor. The linkage may provide for adjustment of mechanical advantage or range of motion through selection of slots or holes formed in parts of the linkage structure.

12 Claims, 5 Drawing Sheets

FIG. 2
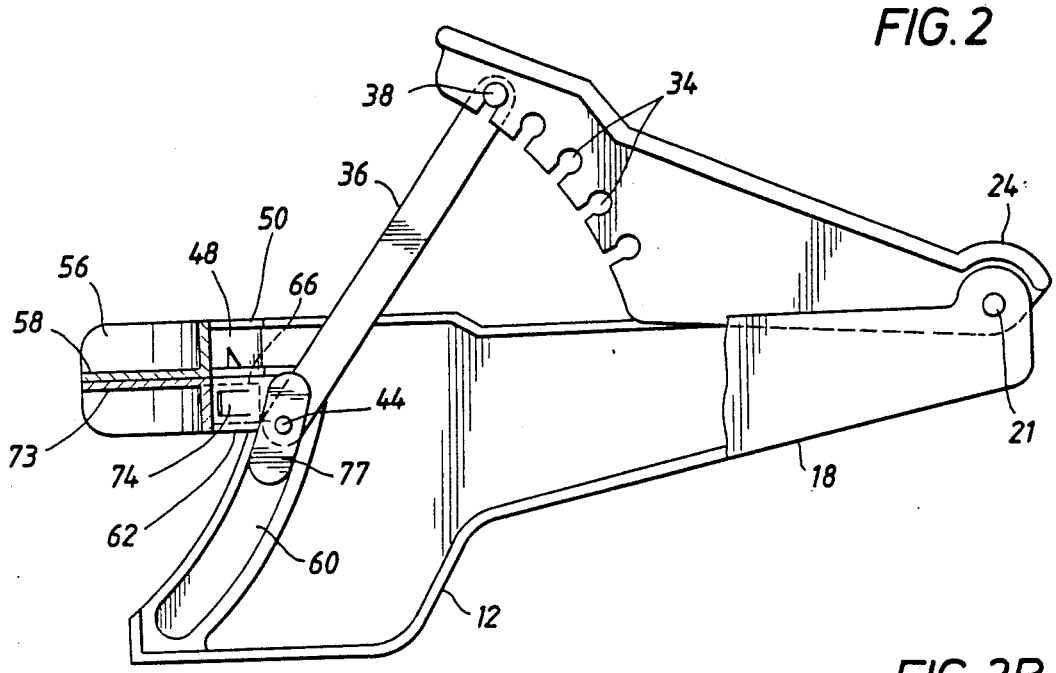
FIG. 2B
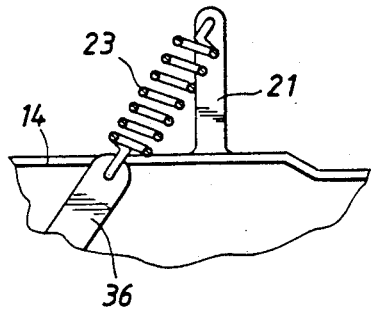
FIG. 2A
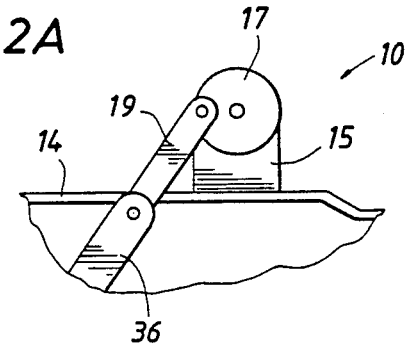
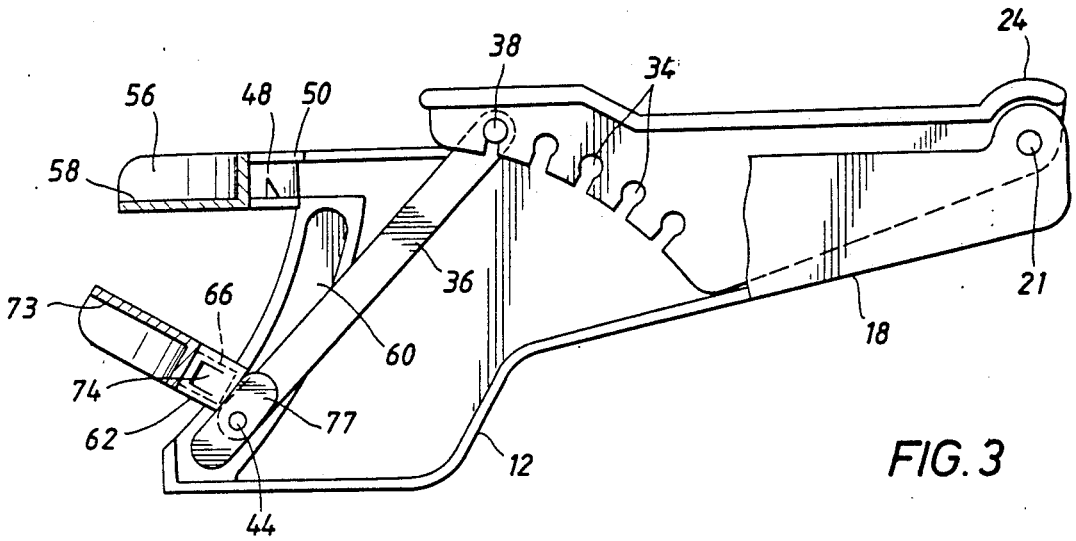
FIG. 3

FIG. 9
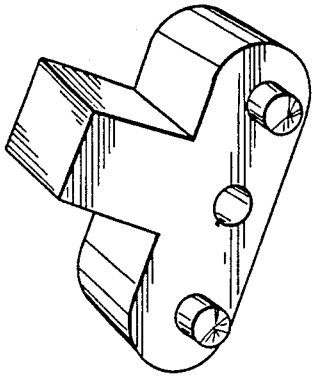
FIG. 10
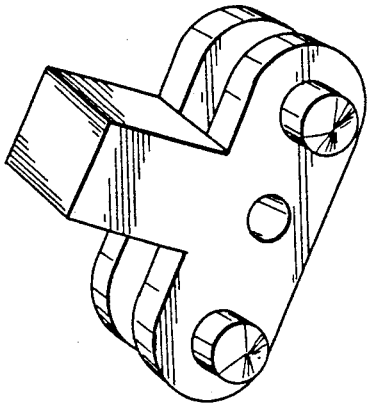
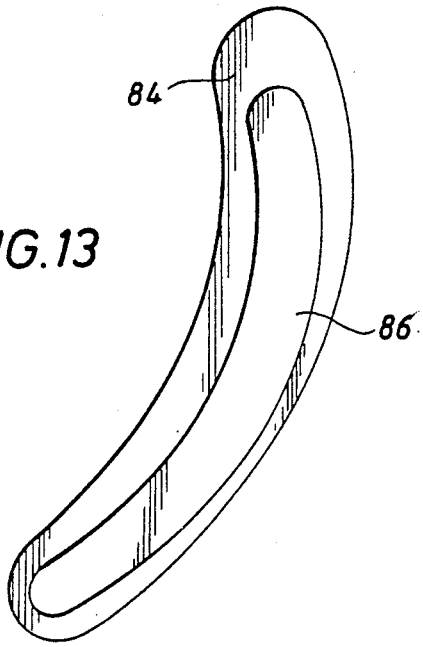
FIG. 13
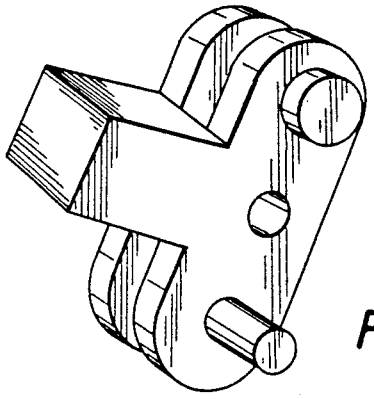
FIG. 11
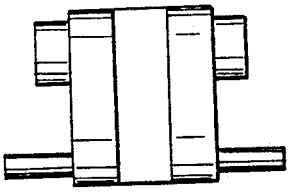
FIG. 12
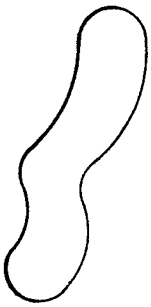
FIG. 14
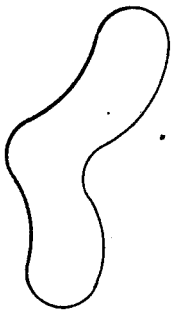
FIG. 15
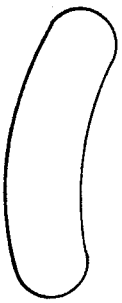
FIG. 16

JAW EXERCISER

This invention is a continuation-in-part of U.S. Ser. No. 07/276,695 which was filed on Nov. 28, 1988 by Reinier Beeuwkes, III, et al. and entitled PASSIVE JAW EXERCISER, now U.S. Pat. No. 4,909,502.

FIELD OF THE INVENTION

This invention relates generally to jaw exercising devices for use in exercising the jaws of patients who have fractured the jaw bone and/or have undergone maxillo-mandibular or temporo-mandibular surgery or in whom the range of motion of the mandible is abnormally limited. More particularly, this invention is directed to a passive jaw exerciser mechanism including maxillary and mandibular jaw members that are inserted into fully seated relationship with the teeth or other mouth tissues such as the palate or gingiva of the respective maxillary and mandibular arches and provides for controlled movement of the jaw pieces such that jaw opening movement occurs in natural anatomical manner or specifically prescribed about the temporo-mandibular joint of the patient. Though the present invention is discussed herein particularly in relation to engagement between the jaw members of the apparatus and the teeth of the patient, it should be understood that such is not intended as limiting the spirit and scope of this invention, it being intended that the apparatus may be designed to apply force to other mouth tissues such as the gingiva and palate instead of the teeth.

BACKGROUND OF THE INVENTION

Exercise of jaw muscles is an important part of treatment and rehabilitation for many jaw injuries and disorders. For example, the common practice of wiring jaws closed as a splinting approach to fractures and bone surgical procedures leads to a shortening of the muscles that close the jaw and a weakening of the muscles that open it. As a result, patients may find it impossible to open their mouths after the wiring has been removed. Physicians and surgeons resort to expedients which include prying with tongue depressors and the use of screw operated wedge devices to stretch the muscles and thereby accomplish opening of the mouth. Once the jaws are opened, it is necessary for patients to undertake exercises to stretch the muscles in order to regain full freedom of motion. Though to date jaw exercise devices have considered only opening and closing movement of the jaw, it may be desirable to impart lateral as well as pivotal movement to the mandible during its normal opening and closing movement as therapeutic movement of the temporo-mandibular joint as well as the muscle system for mandibular control. Passive elastic devices have been suggested for accomplishing jaw exercising. Also, expensive spring operated instruments have been developed for this purpose.

A typical defect of most commercially available jaw exercising devices is that they either cause pain and injury through the exertion of excessive force or they may apply pressure to the molar region in a vertical manner thus displacing the condyles downward and disrupting the temporo-mandibular joint. None of these devices moves the lower jaw in a fashion which takes into account the structural features of the jaw hinge established by the temporo-mandibular joint, namely that the pivotal area of the jaw hinge is above and to the rear of the mouth opening by virtue of the curvature of the jaw at its upper rear portion and that the temporo-mandibular joint does not establish a single precise, pivot point about which the mandible rotates. Rather, the temporo-mandibular joint forms a movable pivot which causes compound movement of the mandible throughout its rotation.

It is a principal feature, therefore, to provide a novel jaw exercising mechanism which accomplishes movement of the jaw by applying pressure to the teeth along the natural anatomical lines taking account of the natural angles of motion of the mandible.

It is also a feature of this invention to provide a novel passive jaw exercising device that avoids injury by allowing the patient to continuously meter the force that is applied to accomplish opening movement of the jaw.

It is an even further feature of this invention to provide a novel passive jaw exercising device that adjusts for both jaw size and for range of motion and provides for graded application of force for both opening and closing motions.

It is another feature of this invention to provide a novel passive jaw exercising mechanism that utilizes a hand grip designed to take advantage of the natural strength and endurance of the patient's first and second fingers and the patient's hand in general to provide both opening force and closing resistance to the jaw and thereby accomplishes exercising of the muscles that open and close the jaw.

It is another feature of this invention to provide a novel therapeutic jaw exerciser that is capable of inducing lateral movement as well as pivotal movement to the mandible or any specifically designed movement that may be desired for appropriate therapy for the patient.

It is a further feature of this invention to provide a novel passive jaw exercising mechanism that can be made inexpensively as a plastic molding for use by a single patient thus insuring against cross contamination between patients and providing for infection control.

It is also a feature of this invention to provide a novel passive jaw exerciser that is adaptable for use by a wide range of patient's having different size jaws through the use of different sized jaw members and/or jaw member extensions.

It is an even further feature of this invention to provide a novel passive jaw exerciser that is capable of providing a motion that is beneficial in facial orthopedics through employment of a motion controlling track of a particular configuration.

SUMMARY OF THE INVENTION

In the preferred embodiment of this invention a passive jaw exercising mechanism constructed in connection with the present invention includes a body structure having a handle extending therefrom. At the free end of the handle is pivotally attached a spring jaw moving lever to which manual jaw opening force is applied by the hand of the patient using the device. The passive jaw exerciser includes maxillary and mandibular jaw members with the maxillary jaw member being removably attached in immovable relation to the body during use. The mandibular jaw member is removably supported by a carriage that is disposed in movable relation with the body.

The body defines an a curvilinear carriage guide track which may define a compound curvilinear form and which may also define lateral simple or compound curvature as well. The carriage guide track receives a guide rail or guide pins of the carriage and thus guides the carriage along the curved track during its movement. For purposes of this invention the term curved or curvilinear guide track is intended to encompass any elongated guide device forming a curvilinear guide surface or surfaces, i.e., guide slots, guide wires, guide ribs or ridges, guide edges defined by elongated members, etc.

A push rod is pivotally connected at one end to the carriage and is adapted at the opposite end to establish connection with any one of several positioning notches or other connector devices in a manually operated handle structure that allow the patient to select the particular mechanical advantage and range of motion that is desired for jaw movement activity. In one form of the invention the positioning notches lie along the arc of a circle which may have its center at the pivot connecting the push rod to the carriage, thus defining a radius or curvature equal to the length of the push rod. Additionally, the manually operated handle may be spring urged toward the jaw open or jaw closed positions as desired. Manual force applied to the push rod causes the carriage to move within the guide track and the curved shape of the track causes the mandibular jaw member to tilt or establish an inclined relation with the maxillary jaw member as it moves downward. The compound curvature of the track will control the tilt angle of the mandibular jaw member so that precise anatomical jaw movement or other selected jaw movement will be induced by the apparatus. Thus, although the tooth engaging surfaces of the jaw members are parallel in the starting position, the tooth engaging surfaces become angularly oriented as well as moved apart as the mandibular jaw member moves toward its open position. The angular relation or tilt is such that the incisors are opened more widely than the molars, mimicking the natural motion of the jaw and thus causing the jaw to pivot about its temporo-mandibular joint. If a different jaw movement is desired for particular facial orthopedics, the configuration of the curved guide track will be of a predetermined configuration to effect selected therapeutic jaw movement.

In use the apparatus will be positioned such that the maxillary and mandibular jaw members are inserted between the teeth of the maxillary and mandibular arches of the patient with the maxillary jaw member in full contact with the teeth of the maxillary arch for proper alignment of the exerciser device and with the teeth of the mandibular arch fully engaging the mandibular jaw member. The patient will then grasp the handle of the device with the patient's fingers in contact with the operating lever. By applying force to the lever, causing it to pivot relative to the handle, the force applied by the patient is transmitted through the push rod to the mandibular jaw member, causing it to move within the curved track. The patient is capable of controlling movement of the mandibular jaw member to the extent appropriate for jaw exercising activities. In the opposite direction, the patient can then close the jaw through use of the jaw muscles while manually applying force as resistance to jaw closing movement. Thus, the muscles of the jaw are capable of being exercised during both opening and closing movement while the jaw is controllably and anatomically moved about, or in, desired relation with its temporo-mandibular joint.

Especially in the case of partially or completely edentulous patients and in other selected circumstances, the jaw members may be of a configuration for force transmitting engagement with mouth tissues other than the teeth. For example, both the maxillary and mandibular jaw members may be designed for contact with the gingiva. Alternatively, the maxillary jaw member may be designed to fit a desired portion of the palate.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

Figure 1:
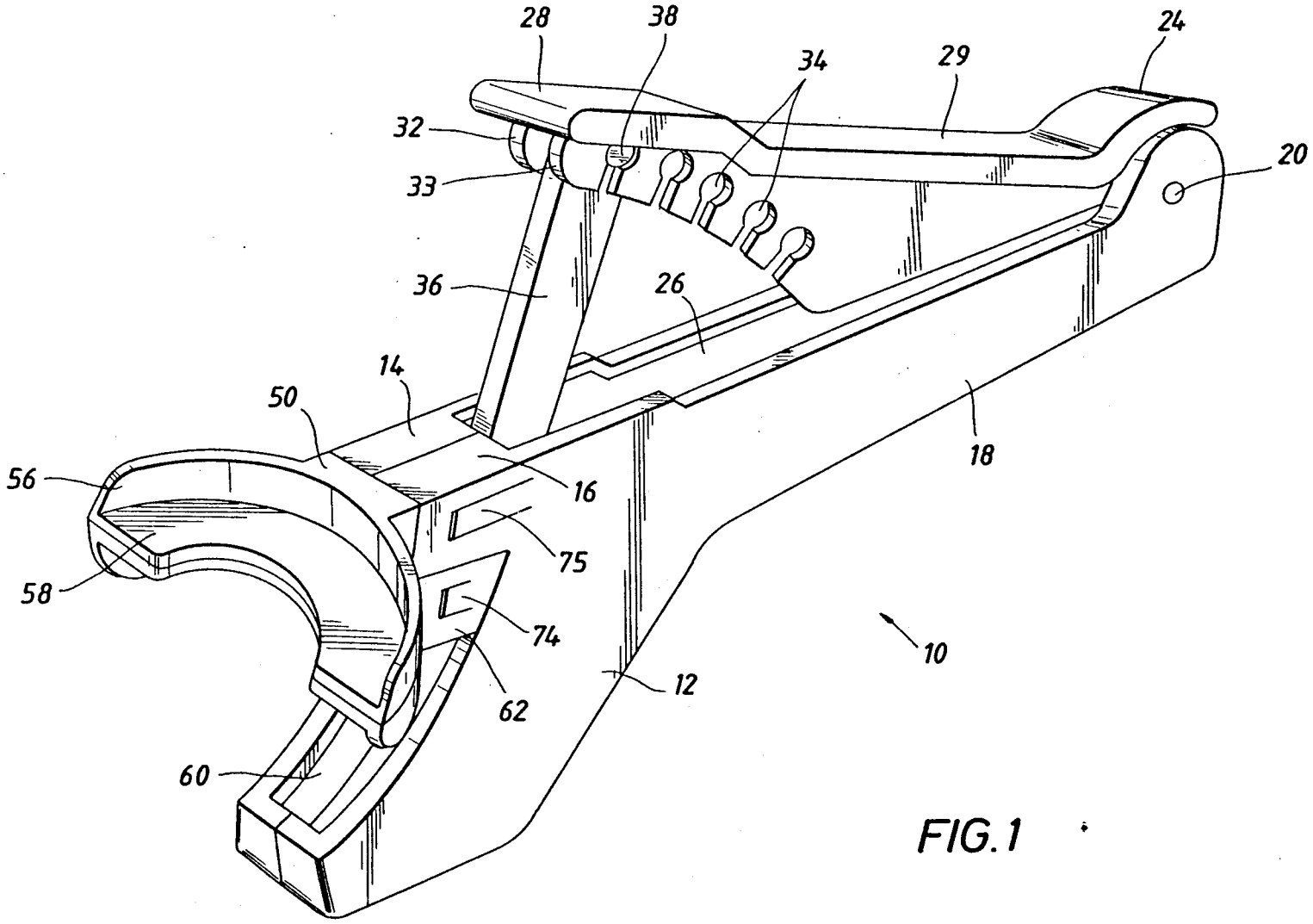

FIG. 1 is an isometric illustration of a passive jaw exerciser mechanism constructed in accordance with the present invention and showing the jaw members thereof in the position for maximum closure of the jaw.

FIG. 2 is an sectional illustration of the apparatus of FIG. 1 showing the jaw members in the closed position thereof.

FIG. 2A is a fragmentary elevational view of the carriage operating portion of a jaw exerciser representing an alternative motor energized embodiment of this invention.

FIG. 2B is a fragmentary elevational view of the carriage operating portion of a jaw exerciser representing a further alternative embodiment imparting resistance force to the mandibular jaw member.

FIG. 3 is a sectional view of the passive jaw exerciser device of FIGS. 1 and 2 with the jaw members thereof shown in the open position.

Figure 4:
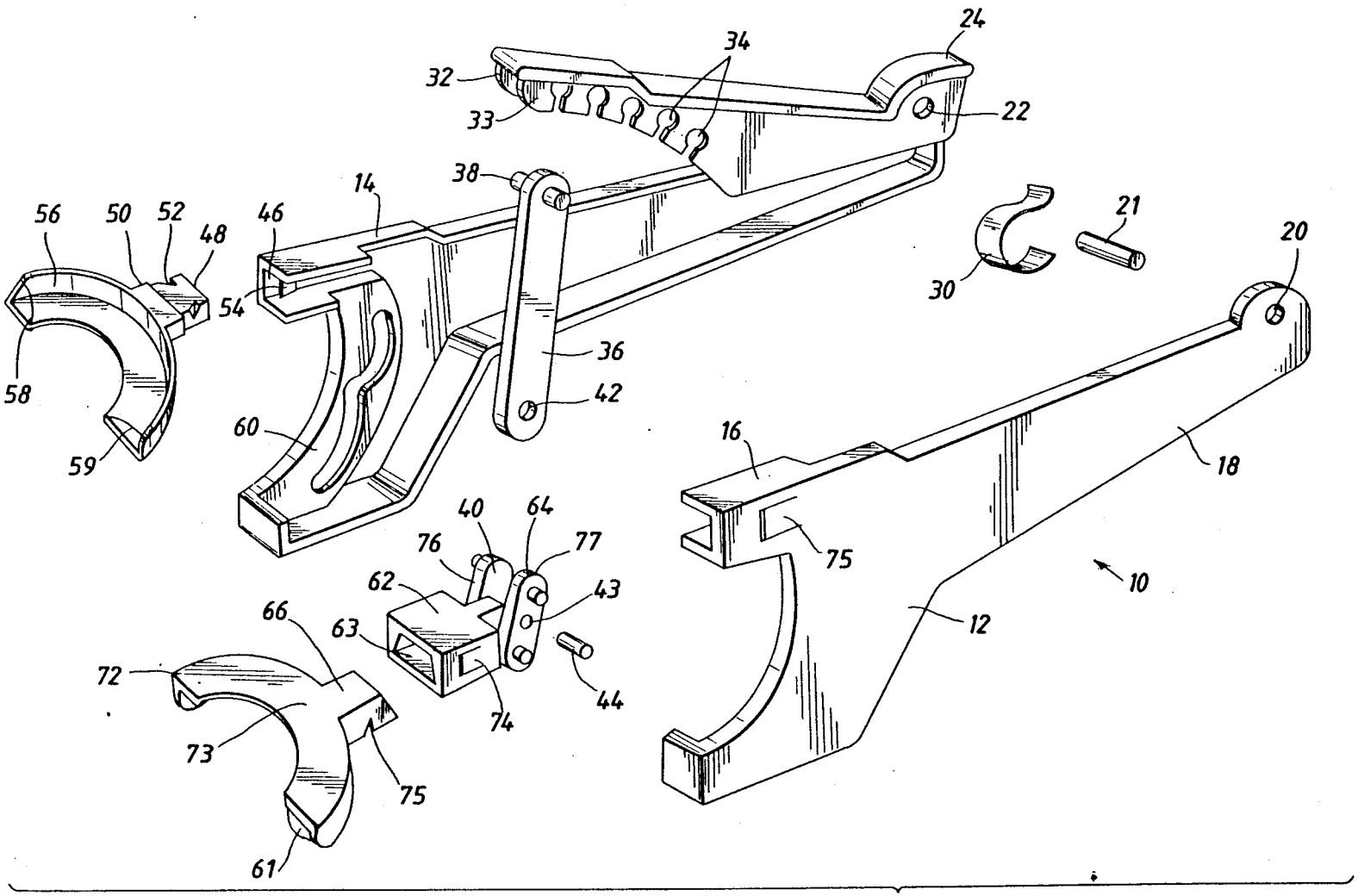

FIG. 4 is an exploded isometric view of a passive jaw exerciser apparatus representing an alternative embodiment of this and invention and illustrating the various component parts thereof.

Figure 5:
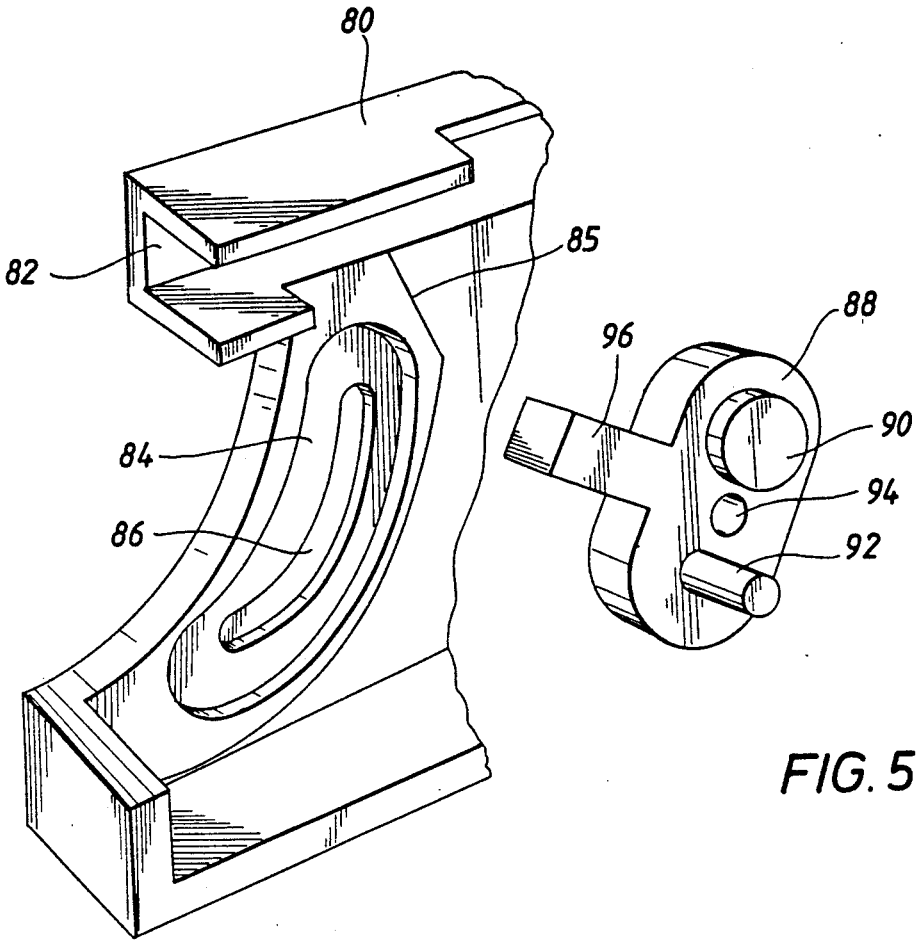

FIG. 5 is a partial isometric illustration of one-half of the forward end of a passive jaw exerciser representing a further alternative embodiment of this invention.

FIG. 5A is an isometric illustration of the carriage portion of the passive jaw exerciser of FIG. 5.

Figure 6:
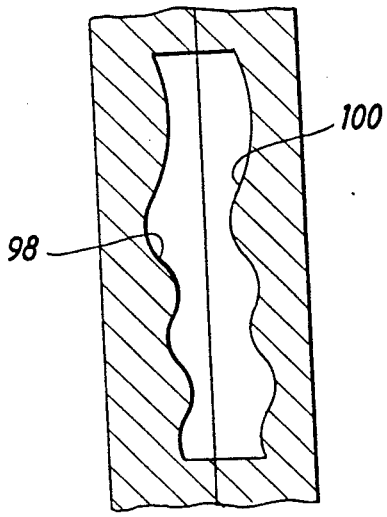
Figure 7:
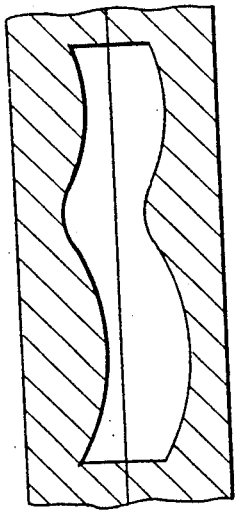
Figure 8:
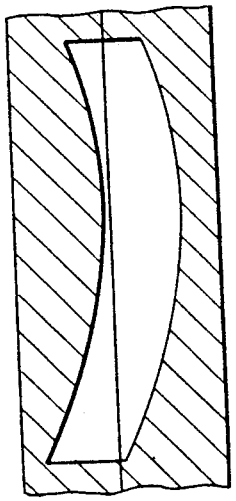

FIGS. 6, 7 and 8 are partial sectional views illustrating various guide track configurations designed for imparting lateral movement to the carriage and jaw member during movement of the carriage.

FIGS. 9–11 are isometric illustrations of various carriages that are designed for cooperative relationship with various carriage guide tracks such as illustrated in FIGS. 5–8 and 13.

FIG. 12 is an elevational view of the rear portion of the carriage of FIG. 11.

FIG. 13 is an elevational view of the apparatus of FIG. 5 illustrating the configuration of the carriage guide and orienting tracks.

FIGS. 14–16 are also partial elevational views of diagrammatic form illustrating various carriage guide track configurations that may be incorporated within the apparatus of FIG. 5.

DETAILED DESCRIPTION OF PREFERRED EMBODIMENT

Referring now to the drawings and first to FIG. 1, 2 and 3 a passive jaw exerciser mechanism constructed in accordance with the present invention is shown generally at 10 by way of isometric illustration. The apparatus incorporates a body structure 12 that is formed by substantially mirror image body halves 14 and 16. The body structure 12 incorporates a handle 18 defined cooperatively by the interfitting body halves which forms a pivot aperture 20 that receives a pivot pin 21 which also engages within a pivot aperture 22 defined at one end of a pivotal lever 24. The lever 24 extends through an elongate rectangular opening 26 defined by the handle portions of the body halves and forms a curved upper flange portion 28 which that forms a grip section 29 that is engaged by the fingers of the user's hand to facilitate manual manipulation of the lever to accomplish jaw opening movement and to permit application of manual resistance force to resist jaw closing movement. The lever 24 is urged toward its upstanding position as shown in FIG. 1 by means of a spring element 30 shown in FIG. 4 which may conveniently take the form of a torsion spring, leaf spring or any other suitable spring member. The lever 24 defines a pair of web members 32 and 33 extending transversely to the upper finger engaging flange portion 28 thereof. The web members each define a plurality of positioning slots 34 spaced along the length of the curved inner surface portions thereof. The positioning slots 34 may be arranged in an arc of a circle having its center at a pivot connecting a push rod to a jaw moving carriage as will be discussed herein below. Alternatively, the positioning slots may be oriented in any other spaced relation that is suitable for application of manual force to the movable jaw member and to provide the desired mechanical advantage for manual manipulation of the apparatus. A push rod member 36, which cooperates with the lever 24 to form a force transmitting linkage, defines an upper transverse projection 38 adapted to be received within portions 32 and 33 of the handle to establish movement of the mandibular jaw member and to provide selected mechanical advantage as desired by the patient. The lower end of the push rod 36 is received within a slot 40 formed by a carriage member 62 and forms an aperture 42 which is disposed in registry with pivot apertures 43 of the carriage 62 and is pivotally secured to the carriage by means of a pivot pin 44. This enables the lower end of the push rod to be pivotally connected to the jaw moving carriage member as will be explained in detail hereinbelow.

At the forward end of the body structure 12 the body halves 14 and 16 cooperate to define an opening 46 that is adapted to receive the connecting projection 48 of a maxillary jaw member 50 in close fitting relation therein. The connecting projection 48 may be of corresponding trapezoidal configuration to ensure that the jaw member 50 is properly oriented when assembled to the body structure 12, opening 46 and element 48. The connecting projection 48 forms a pair of opposed locking notches 52 that are engaged by latch members 54, formed by the respective body halves, when the projection 48 of the maxillary jaw member 50 is inserted into the receptacle or opening 46 and locked in position in the manner shown in FIGS. 1, 2, 3 and 4. The maxillary jaw member is substantially immovable relative to the body structure 12. The purpose of the trapezoidal configuration of the receptacle 46 and the connecting projection 48 is to ensure proper orientation of the jaw members upon their assembly to the body structure and carriage. It should be appreciated that connecting structures of other design may be employed in like manner to ensure proper orientation of the jaw members. Maxillary jaw member 50 forms a curved upstanding wall 56 that conforms substantially to the arch form of the patients anterior teeth and also forms a substantially flat plate 58 which may be integral with the upstanding wall portion 56 and other structural portions of the maxillary jaw member and which is of curved configuration. The plate 58 is adapted to be engaged by portions of the occlusal and incisal surfaces of the patient's teeth to thus allow the maxillary jaw member to be aligned with respect to the bite plane of the teeth. It is this alignment that insures movement of the patient's jaw about the temporal-mandibular joint.

In circumstances where the incisal edges of the patient's teeth do not form a positive bite plane due to irregular height, only a few of the teeth may be in force transmitting contact with the planar surfaces of the jaw members. In such case these teeth may be subjected to excessive forces. To provide for more even distribution of forces between the jaw members and the teeth of the patient or to other mouth tissues such as the gingival tissues of the alveolar arch. Each of the jaw members may be provided with force distributing mouth inserts which establish proper engagement with the teeth, the gingival tissues or the palate as is desired for appropriate jaw exercise therapy. In one suitable form, the mouth engaging inserts, illustrated at 59 and 61 in FIG. 4, may be composed of soft rubber or any one of a number of suitable resilient polymer materials that are appropriate for use within the oral cavity. Obviously in this case the configuration of the jaw members themselves may be appropriately altered for appropriate mouth tissue engagement.

In one form of the invention, as shown in FIGS. 2 and 3, the body halves 14 and 16 further define opposed internal tracks 60 in the form of curved slots having a curvature that, with the maxillary jaw member aligned with respect to the bite plane of the patient, a "virtual" hinge point is established that is close to the patient's temporal-mandibular joint. In all cases according to the scope of this invention, the present jaw exercise device provides at least one carriage guide track that is positioned in front of the mouth of the patient. In other forms of the invention the location and curvature of the tracks 60 may be designed such as to provide a motion of the mandible which is beneficial in facial orthopedics, therapeutically corrective of muscle dysfunction and helpful to therapeutic manipulation of the temporomandibular joint.

As shown in FIG. 4 of the drawings, the passive jaw exerciser includes a carriage member 62 forming a rearwardly extending bifurcated projection 64 that forms a slot 40 into which the push rod 36 is received. The projection 64 also defines apertures 43 that receive pivot pin or bolt 44 that also extends through the aperture 42 of the push rod to maintain the push rod and the projection 64 in pivotal assembly. The slot 40 receiving the lower end of the push rod, is aligned with respect to the space defined between the webs 32 and 33 of the lever 24, thus permitting centralized force transmission from the lever, through the push rod to the central portion of the carriage.

At its forward extremity the carriage 62 defines a receptacle 63 which may be of generally trapezoidal configuration and which receives the connecting projection 71 of a mandibular jaw member 72 therein. The carriage also defines opposed latch elements 74 that engage within appropriate locking slots 75 formed in the connector extension of the jaw member to latch the jaw member into positively assembled relation with the carriage. The jaw member 72 may be of identical construction as compared with the construction of the maxillary jaw member 50 but merely inverted for registry with the teeth or other mouth tissues of the patient's mandibular arch or jaw. The jaw members and the body and carriage also form flat mating surfaces such as shown at 73 that allow the flat plates of the jaw members to be positioned in juxtaposed relation as shown in FIG. 1. This enables the flat plates of the jaw members to be inserted between the maxillary and mandibular teeth of the patient even when minimal jaw movement is allowed. The force distributing inserts 59 and 61 may be removable or the jaw members may be replacable to accommodate the minimal jaw movement that is typically allowed as exercise therapy is initiated following surgery. The use of connector receptacles of trapezoidal configuration in both the body structure and carriage of the passive jaw exerciser insures that the maxillary and mandibular jaw members can only be assembled to the body and carriage in the positions shown in FIG. 1. Obviously, the connecting receptacles may be of any other suitable configuration that insures that the maxillary and mandibular jaw members can be assembled to the body and carriage only in the proper positions.

To establish a properly guided relation of the carriage relative to the body structure the carriage member is provided with a pair of curved opposed guide rails 76 and 77 which are received in guided relation within the curved slot or guide track 60 of the body structure. Thus, as force is applied through the handle and push rod to the carriage 62, the carriage is restricted in its movement to the length and curvature of the track 60. Force applied to the push rod causes the carriage to move within the guide track and the shape of the track causes the mandibular jaw member to tilt as it moves downwardly. Thus, although the flat occlusal surfaces of the jaw members are disposed in intimate parallel relation at the starting position of the apparatus with the lever 24 in the position shown in FIGS. 1 and 2, the occlusal plates 58 and 73 of the jaw members or their respective inserts will maintain engagement with the teeth or other mouth tissues during movement and will become inclined to one another as well as moved apart as the jaw is moved toward its fully open position. The tilt or incline of the jaw members is such that the incisors are opened more widely than the molars, thereby mimicking the natural anatomical motion of the jaw as it pivots about the temporo-mandibular joint.

Although a manually operated jaw exercise mechanism such as shown in FIGS. 1, 2 and 3 is the preferred embodiment, it may also be desirable to provide a jaw exerciser mechanism that is motor operated as shown in FIG. 2A or which provides resistance to motion of the carriage and mandibular jaw member as shown in FIG. 2B. As shown in the fragmentary elevational view of FIG. 2A, one or both of the body halves 14 and 16 of the body structure 10 may be provided with a motor support 15 having an electric motor 17 disposed in fixed relation thereto. The drive shaft of the motor 17 may impart rotary motion to an eccentric arm 19 to which the push rod 36 is pivotally connected. As the eccentric arm 19 is rotated by the motor, the push rod 36 will be reciprocated, thus imparting reciprocation to the carriage and to the mandibular jaw member connected thereto. The motor 17 may be provided with any suitable gear mechanism or speed control to thereby provide for controlled reciprocation of the push rod as suits the character of therapy that is desired.

The fragmentary elevational view shown in FIG. 2B illustrates a jaw exerciser wherein the mandibular jaw member is provided with a resistance force which must be overcome by the jaw of the patient in order to impart movement to the mandibular jaw member. As shown in FIG. 2B the body halves 14 and 16 may be provided with a spring support 21 to which the upper end of a tension spring 23 is attached. The lower end of the spring 23 is attached to the upper end of the push rod 36, thereby placing the push rod under compression. Thus, for movement of the mandibular jaw means, the compression resistance of the spring 23 must be overcome and the muscles of the patient's jaw will be strengthened by resistance exercise of this nature.

In order to accommodate patient's jaws of different sizes, interchangeable jaw members can be provided in small, medium and large dimensions. Further, the jaw members are designed to receive inserts 59 and 61 composed of a resilient impression compound in order to equalize the force distribution on teeth and gums in edentulous and partially edentulous patients. The jaw members may be provided with connector extensions of varying length in order to achieve the character of movement that is desired for the patient.

The opposed parallel webs 32 and 33 of the lever 24 is provided with a series of positioning slots 34 within which the transverse transverse pin 38 of the push rod is received in releasable engagement. These spaced notches are located along the arc of a circle having its center at the pivot point of the carriage 62 which is formed by apertures 43. Thus, the starting height of the lever i s the same regardless of which set of notches is engaged by the pin 38 of the push rod. The shape of the notches defines an outer restriction through which the pin 38 must be forced to establish full engagement of the pin within the respective notches. This notch shape and the relationship of the notches with the transverse pin 38 of the push rod allows the push rod to snap into assembly with a respective notch and be detained within the opening; but to allow simple relocation of the push rod by the patient or physician. Numbering of the notches, such as from 1 to 5 for example, with notch 5 being the notch closest to the pivot point of the lever 24, can provide a scale of force to thus allow the patient or physician to select a desired mechanical advantage to provide the force that is appropriate at any given time for the therapy that is desired for the patient.

The carriage and handle are preferably molded from materials which slide easily on one another. For example, the carriage may be composed of any one of a number of suitable polymers such as acetal while the body structure and other components of the jaw exerciser may be composed of nylon or any other suitable material. Metals may also be employed if desired. This insures smooth transmission of force from the lever to the mandible. The materials may be chosen to permit autoclaving or other types of sterilization. The latch devices for the jaw members may be designed either to allow or prevent removal of jaw members once inserted.

With reference now to FIGS. 5–16, it may be desirable during exercise therapy to provide for guided movement of the mandibular jaw member and thus movement of the mandible in a manner that may be other than precise normal anatomical movement for proper exercise of the jaw muscles and the temporo-mandibular joint according to prescribed therapy.

FIG. 5 is a partial isometric illustration of the forward part of a passive jaw exerciser body structure 80 which is similar to the body structure 18 of FIG. 1. A receptacle 82 is defined cooperatively by interfitting body halves which is designed to receive the connecting projection of a maxillary jaw member of the nature shown at 50 in FIGS. 1, 2 and 3. Each half of the body structure forms a large carriage guide track 84 of a particular curvature and orientation and a small carriage guide track 86 having a curvature and orientation, including a compound curvature if desired, that is different from that of the large guide track 84. As shown in FIG. 5A a mandibular carriage 88 is provided with guide means which may take the form of large transversally projecting guide pins 90 on opposite sides thereof that are engageable within the large guide tracks 84. The carriage also provides additional guide means which may take the form of a pair of opposed small guide pins 92 that are of sufficient length and dimension to be received in close fitting, guiding relationship with the small guide tracks 86. The carriage also defines an aperture 94 through which may extend a pin such as that shown at 44 to establish a pivotal connection between the carriage 88 and the aperture 42 of the push rod 36.

The carriage 38 further defines a transversely projecting connector element 96 which is adapted to be received within a connector receptacle of a mandibular jaw member of the general nature shown at 62. As the carriage 88 is moved by the push rod in similar manner as shown in FIGS. 2 and 3 the large guide pins will be guided by the surfaces forming the guide track 84 while the small guide pins 92 are received in closely fitting guided relation within the small guide tracks 86 and the spaced pairs of guide pins. As the carriage 88 is moved, the cooperating guide tracks 84 and 86 and the spaced pairs of guide pins induce particularly designed movement to the carriage thus causing the projection 96 to move the corresponding jaw member in a prescribed manner. The movement of the patient's jaw, therefor, may mimic normal anatomical jaw movement or, in the alternative, may establish any other jaw movement that is prescribed for therapeutic purposes. For example, for manipulation of certain jaw muscles, particular carriage movement may be desired to impart particular movement to the mandibular jaw piece.

Further, particularly designed movement of the temporo-mandibular joint may also be desired after surgical procedures according to the therapy that is prescribed. Thus, the carriage guide slots or tracks 84 and 86 may be of any suitable prescribed orientation that causes the carriage to have desired movement, including compound curved movement, as it is moved along the length of the guide tracks. In some cases, as shown at FIGS. 10 and 11, the carriage design may utilize guide pins of similar dimension such that the carriage has a pivotal movement as it is moved arcuately along the curved guide tracks.

Further, where lateral jaw movement is also desired for therapeutic exercise, the guide tracks may define opposed lateral guide surfaces as shown in FIGS. 6, 7 and 8. As shown in FIG. 6, lateral guide surfaces 98 and 100 react appropriately with the guide pins to induce lateral movement to the mandibular jaw member as it is moved during jaw exercise. This will induce a lateral movement to the patient's jaw as it is opened and closed, thus causing the temporo-mandibular joint to have some degree of therapeutic manipulation. As the jaw is moved for proper engagement with the lateral guide surfaces, the guide pins, as shown in FIGS. 9 and 10 will have hemispherical or conical extremities as shown in FIGS. 9 and 10 to establish point contact with the lateral guide surfaces.

FIG. 13 illustrates the differing curvature of the large and small guide track slots 84 and 86. FIGS. 14–16 illustrate different guide slot configurations that may be appropriate to particularly designed jaw therapy as selected by the physician or by the patient.

It is also practical to provide a passive jaw exerciser apparatus with guide slot inserts that are removably positioned in assembly with the body halves. Thus by providing a body structure of standard form, the removable inserts such as shown at 85 in FIG. 5 may be selected by the physician according to the needs of the patient. Further, during the period of therapy, the removable guide track elements may be removed and replaced with different guide track elements that establish differing jaw movement without necessitating complete substitution of the jaw exercising device. The removable insert members 85 may be secured to the body structure in any suitable manner, but typically they will be received within appropriate receptacles formed in the body halves to insure that they remain in substantially fixed relation to the body halves during use of the apparatus.

The patient would be expected to use this passive jaw exerciser device several times a day for a period up to six months. The patient would begin using the lever in a position of greatest mechanical advantage, which is established when the transverse projection 38 of the push rod 36 located within the slot 34 closest to the pivot 20, which shall be referred to as position 5, which causes small relative motion to the jaw members while allowing greater force to be exerted to the jaw members through the lever and push rod. Successive adjustments would be made as the jaw mobility of the patient progresses, ending in the position of the push rod 36 and its transverse projection as shown in FIG. 1, which shall be referred to herein as position 1, assuming that the patient's jaws have a full range of motion. For exercise in closing the jaw, the patient may begin with the exerciser device 10 in the position 1 configuration as shown in FIG. 1, opening the jaw with gentle pressure on the lever and closing it against manual force applied through the lever and push rod. The spring 30 may be employed to apply opening or closing movement to the jaw members as desired. The device may be provided in connection with a chart or work sheet in which the patient may use as a guide to exercising and as a progress sheet.

By interlocking the upper part of the push rod 36 with selected ones of the different positioning notches 34 of the lever, both the range of motion and the mechanical advantage of the apparatus may be adjusted. By using a notch close to the pivot point of the lever as a high mechanical advantage appropriate to the large forces required to move a nearly closed jaw is obtained. By using a notch near the tip of the lever a large range of motion about 1½ inches is obtained with no mechanical advantage. This is ideal for both opening and closing exercises in the latter stages of jaw rehabilitation.

In use, the patient will hold the passive jaw exerciser by the handle 18. The thumb passes under the handle and the fingers will wrap around the movable lever 24 with the fingers engaging the smoothly curved upper surface 28 thereof. The patient will then insert the curved maxillary and mandibular jaw members 50 and 72 between the teeth, with the jaw members positioned in the closed relation shown in FIG. 1. This requires that a small degree of opening, about ¼ inch has already been achieved to allow the jaw members to be inserted. The patient, by closing the hand will then squeeze the lever 24 towards the handle and the push rod 36 will cause the mandibular jaw member to move downwardly along the curved track. The curvature of the track causes a virtual hinge point close to the patient's temporo-mandibular joint. Thus, the mandibular jaw member tilts as it moves downwardly, following the natural motion of the lower jaw. By interlocking the upper part of the push rod with different notches in the lever, both the range of motion and the mechanical advantage may be adjusted.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A jaw exerciser for application of jaw moving force or resistance for moving the jaw and exercising the jaw muscles and temporo-mandibular joint of a patient comprising:

(a) an exerciser body being capable of supporting fixed maxillary jaw exercising means and forming curvilinear guide track means capable of receiving movable mandibular jaw means, when said jaw exerciser is being used by a patient said curvilinear guide track means being located in front of the temporo-mandibular joint of the patient;

(b) maxillary jaw means extending from said exerciser body and having a maxillary jaw engaging member adapted for force transmitting engagement with maxillary tissues of the mouth of the patient;

(c) mandibular jaw means being movably received by said exerciser body and being located on one side of said curvilinear guide track means, said mandibular jaw means having a mandibular jaw engaging member adapted for force transmitting engagement with the tissues of the mandible of the patient, said mandibular jaw means being received in guided relation with said guide track means;

(d) said curvilinear guide track means being defined by at least one center of curvature located on the same side of said guide track means as said mandibular jaw engaging means, said guide track means having a configuration establishing predetermined therapeutic exercise movement of the patient's jaw by said mandibular jaw means; and (e) a mechanical linkage being connected to said exerciser body and having driving connection with said mandibular jaw means, said mechanical linkage being actuated for inducing movement of said mandibular jaw means relative to said exerciser body and said maxillary jaw means.

2. The jaw exerciser of claim 1, wherein said mechanical linkage comprises:

(a) a lever being pivotally mounted to said exerciser body;

(b) a push rod interconnecting said lever and said mandibular jaw means and being actuated manually to thus impart movement to said push rod and said mandibular jaw means.

3. The jaw exerciser of claim 1, including:

a motor being supported by said exerciser body and having driving connection with said mechanical linkage for inducing motor controlled movement to said mechanical linkage and said mandibular jaw means.

4. The jaw exerciser of claim 1, including:

(a) a spring support being defined by said exerciser body; and (b) a spring being interconnected with said spring support and said mechanical linkage for imparting spring force to said mechanical linkage for selectively moving and resisting movement of said mandibular jaw means.

5. The jaw exerciser of claim 1, wherein said guide track means defines a compound curvilinear configuration.

6. The jaw exerciser of claim 1, wherein said guide track means is of lateral curvilinear form to induce lateral movement to said mandibular jaw means during movement of said mandibular jaw means along said guide track means.

7. The jaw exerciser of claim 1, wherein said guide track means is defined by a plurality of curvilinear guide tracks having differing curvilinear configuration.

8. The jaw exerciser of claim 7, wherein said guide elements comprise:

two guide elements being disposed in spaced relation on the carriage and extending from each side of said carriage member each of said guide elements being received in guided relation with respective ones of said plurality of curvilinear guide tracks and being guided by said curvilinear guide tracks to induced predetermined rotational movement to said carriage member during its force transmitting movement relative to said exerciser body and said maxillary jaw means.

9. The jaw exerciser of claim 8, wherein said curvilinear guide track means comprises:

(a) a first opposed pair of guide tracks of curvilinear form being defined by said exerciser body means;

(b) a second opposed pair of guide tracks of different curvilinear form than said first opposed pair of guide tracks; and (c) said two guide elements of each side of said carriage member being guide pins received in guided relation with respective ones of said first and second guide tracks.

10. The jaw exerciser of claim 1, wherein said mandibular jaw means comprises:

(a) a lever being pivotally mounted to said exerciser body;

(b) a carriage member being movably supported by said body means and having guide elements thereon establishing guided interfitting relation with said curved guide track means;

(c) a push rod establishing driving relation between said lever and said carriage member and being manually manipulated to impart driving movement to said carriage member; and (d) a jaw engaging member being supported by said carriage member and being adapted to establish force transmitting engagement with predetermined mouth tissues of the patient.

11. The jaw exerciser of claim 1, wherein:

(a) said exerciser body forms guide track receptacle means; and (b) a pair of guide track inserts being removably received in substantially immovable relation with said guide track receptacle means, said guide track inserts each forming said curvilinear guide track means.

12. A jaw exerciser for application of applied jaw moving force for moving the jaw and exercising the jaw muscles and temporo-mandibular joint of a patient comprising:

(a) an exerciser body being capable of supporting fixed maxillary jaw exercising means and forming a handle adapted to be grasped by a user and forming guide track means of curvilinear configuration and capable of receiving movable mandibular jaw means, when said jaw exerciser is being used by a patient said curvilinear guide track means being located in front of the temporo-mandibular joint of the patient;

(b) maxillary jaw means extending in substantially immovable relation from said exerciser body and having a maxillary jaw engaging member adapted for transmitting engagement with the teeth or other maxillary tissues of the mouth of the patient;

(c) a carriage member being movably received by said exerciser body and defining guide means being received in guided relation with said curvilinear guide track means;

(d) mandibular jaw means extending from said carriage member and being located on one side of said curvilinear guide track means, said mandibular jaw means being movable along with said carriage member and forming mouth engaging means for selective engagement with the teeth, gingiva or other mandibular mouth tissues of the patient;

(e) said curvilinear guide track means being defined by at least one center of curvature located on the same side of said guide track means as said mandibular jaw engaging means and having a configuration establishing predetermined therapeutic exercise movement of the patient's jaw by said mandibular jaw means about said temporo-mandibular joint; and (f) an operating linkage being connected to said exerciser body and having driving connection with said carriage means, said operating linkage being operated for inducing movement of said carriage means and said mandibular jaw means relative to said exerciser body and said maxillary jaw means.

* * * * *